US010260283B2

(12) United States Patent
Gregory

(10) Patent No.: US 10,260,283 B2
(45) Date of Patent: Apr. 16, 2019

(54) STEPLADDER BASED CRANE SYSTEM

(71) Applicant: Michael Gregory, Gilbert, AZ (US)

(72) Inventor: Michael Gregory, Gilbert, AZ (US)

( * ) Notice: Subject to any disclaimer, the term of this patent is extended or adjusted under 35 U.S.C. 154(b) by 544 days.

(21) Appl. No.: 14/683,356

(22) Filed: Apr. 10, 2015

(65) Prior Publication Data

US 2016/0245019 A1 Aug. 25, 2016

Related U.S. Application Data

(60) Provisional application No. 61/978,368, filed on Apr. 11, 2014.

(51) Int. Cl.

| | |
|---|---|
| ***E06C 7/12*** | (2006.01) |
| ***E06C 1/20*** | (2006.01) |
| ***B66C 23/18*** | (2006.01) |
| ***B66C 23/20*** | (2006.01) |

(52) U.S. Cl.

CPC ..... *E06C 7/12* (2013.01); *B66C 23/203* (2013.01); *E06C 1/20* (2013.01)

(58) Field of Classification Search

CPC ..... B66C 23/00; B66C 23/06; B66C 23/18; B66C 23/20; B66C 23/203; B66C 23/26; B66C 23/62; E06C 7/12; E06C 1/20

USPC ..... 182/129, 103, 121

See application file for complete search history.

(56) References Cited

U.S. PATENT DOCUMENTS

| | | | | | |
|---|---|---|---|---|---|
| 1,021,629 | A * | 3/1912 | Reichardt | E04G 1/24 | 182/129 |
| 1,386,511 | A * | 8/1921 | Krahl | E06C 7/12 | 182/129 |
| 1,894,489 | A * | 1/1933 | Hirose | E06C 1/32 | 182/125 |
| 3,902,700 | A * | 9/1975 | Cox | E06C 1/34 | 182/102 |
| 4,690,248 | A * | 9/1987 | Killeen | B66C 5/025 | 182/118 |
| 5,139,108 | A * | 8/1992 | Pate | E06C 7/12 | 182/108 |
| 5,738,185 | A * | 4/1998 | Sears | E06C 7/12 | 182/102 |
| 2003/0019689 | A1* | 1/2003 | Dorsett | E06C 7/12 | 182/129 |
| 2005/0236352 | A1* | 10/2005 | Tien | B66C 23/205 | 212/179 |

FOREIGN PATENT DOCUMENTS

GB 2484544 * 4/2012

* cited by examiner

*Primary Examiner* — Michael R Mansen
*Assistant Examiner* — Juan J Campos, Jr.
(74) *Attorney, Agent, or Firm* — The Keith Miller Law Group; Keith Miller

(57) ABSTRACT

An air conditioning crane boom assembly having a number of mounting feet that removably secure the assembly to the rungs of a stepladder. Braces extend from these feet to a boom that extends horizontally away from the rungs of the stepladder. A pulley or a winch may be attached to the base of the boom, near the rungs of the stepladder, and the boom extends away from the stepladder to facilitate safe and stable lifting of loads such as air-conditioner components.

9 Claims, 6 Drawing Sheets

STEPLADDER BASED CRANE SYSTEM

CROSS-REFERENCE TO RELATED APPLICATIONS

The present application is related to and claims priority from prior provisional application Ser. No. 61/978,368, filed Apr. 11, 2014, entitled "LADDER MOUNTED CRANE SYSTEM", the contents of all of which are incorporated herein by this reference and are not admitted to be prior art with respect to the present invention by the mention in this cross-reference section.

STATEMENT REGARDING FEDERALLY SPONSORED RESEARCH OR DEVELOPMENT

Not applicable

BACKGROUND OF THE INVENTION

The present invention relates generally to providing a hoist device for use in lifting objects. More specifically relates to hoisting an air conditioner compressor unit using a portable crane system created by attaching a removable assembly comprising a boom, jib, winch, and handlebar to a stepladder. More particularly this invention relates to providing a system for hoisting an air conditioner compressor unit.

In the field of air conditioner maintained and repairs, technicians may be required to remove a heavy compressor unit from within an air conditioning assembly. The removal of the compressor unit may require lifting of the compressor unit directly upward from inside the air conditioning assembly. The typical weight of the compressor unit in residential air conditioning assemblies is approximately a hundred to a hundred and fifty pounds, with compressor units weighing significantly more in commercial air conditioning assemblies.

Air conditioner compressor units as used in residential and/or commercial air conditioning assemblies can be heavy and difficult for a technician to maneuver. Although the mentioned residential units are not typically large in size, they typically weigh a hundred to a hundred and fifty pounds. Furthermore, although they may be equipped with a handle, the technician must still bend over and pull the unit out using their back or legs. Lifting in this way is not desirable and may result in injuries. The possibility is extremely high that a technician will strain his or her back while either removing or installing the air conditioner compressor unit. Some compressor units come equipped with a D-rings or handles. When such units are being removed it may require it to be lifted higher to clear the edge of the entire air conditioning assembly unit. A safe and portable means for removal of the compressor units from residential and/or commercial air conditioning assemblies is desirable in the industry.

The prior art contains several references showing various types of load maneuvering means. None of the above inventions and patents, taken either singly or in combination, is seen to describe the invention as claimed. Thus, a need exists for a portable, lightweight lifting system that can be quickly unloaded from a vehicle and set-up by one person for use in maneuvering such air conditioning assemblies.

BRIEF SUMMARY OF THE INVENTION

The present invention creates a crane to hoist an air conditioning compressor unit up and out of an air conditioning assembly by attachment of an assembly to any type of stepladder. The crane can then be used so that strain is minimized on the technicians back during the removal or replacing of the compressor unit from within the air conditioning assembly.

The presently preferred embodiment of the present invention provides a crane by removably attaching a boom and jib assembly onto the rungs of a stepladder. The boom and jib assembly extend from the rungs of the stepladder horizontally away from the rungs. A winch is attached to the distal end of the boom, near the attachment of the jib to the boom. A cable extends downward from the winch to connect to the compressor unit in the air conditioning assembly. The jib extends horizontally away from the boom, and extends away from the stepladder. A handlebar is positioned on the jib on the end farthest from the boom and the stepladder. A control module for the winch is positioned near the handlebar to allow ease of use by a single technician while moving and controlling the crane. The handlebar is used to control the crane, and to facilitate safe and stable lifting of loads. The technician operates the crane using the handlebar to easily and safely control the movement of the crane while removing and installing the air conditioning compressor unit from the air conditioning assembly.

Alternatively preferably, a pulley is attached to the distal end of the boom, near the attachment of the jib to the boom, allowing the winch to be positioned elsewhere.

A primary object and feature of the present invention is to provide a crane system overcoming the above-mentioned problem.

It is a further object and feature of the present invention to provide such a crane system that is portable.

Another primary object and feature of the present invention is to provide such a crane system that can preferably be operated by a single person.

It is a further object and feature of the present invention to provide such a crane system that preferably utilizes a stepladder.

A further primary object and feature of the present invention is to provide such a system that is efficient, inexpensive, and handy. It is an object of the present invention to provide an air conditioning compressor unit hoist which is preferably portable, lightweight, and easy to set up while providing satisfactory lifting capabilities to lift a compressor unit up and out of an air conditioning assembly unit.

It is another object of the present invention to provide an air conditioning hoist, which preferably can be used with existing portable stepladders of the type typically used by air conditioning technicians.

It is an object and feature of the present invention to provide a crane system that preferably comprises a stepladder having a plurality of rungs, at least one boom attached to said stepladder at said plurality of rungs, a winch attached to said boom, at least one jib attached to said boom, at least one handlebar attached to said jib.

It is further an object and feature of the present invention to provide a crane system wherein a boom preferably attaches to a stepladder at said plurality of steps using, downward opening channels positioned over said plurality of rungs.

It is further an object and feature of the present invention to provide a crane system wherein a winch is preferably attached to a boom distally from a plurality of rungs.

It is further an object and feature of the present invention to provide a crane system wherein a handlebar is preferably attached to a jib distally from a boom.

It is further an object and feature of the present invention to provide a crane system wherein a control module for said winch is preferably attached to a jib. Alternately preferably it is an object and feature to provide a crane system wherein a control module for said winch is attached to said handlebar.

It is further an object and feature of the present invention to provide a crane system wherein a boom, a winch, a jib, and a handlebar preferably form a single assembly which is preferably removably attached to a stepladder.

It is further an object and feature of the present invention to provide a crane system which preferably comprises a stepladder having a plurality of rungs, at least one boom attached to said stepladder at said plurality of rungs, a pulley attached to said boom, at least one jib attached to said boom, at least one handlebar attached to said jib.

BRIEF DESCRIPTION OF THE DRAWINGS

The particular objects and features of the invention as well as the advantages will become apparent from the following description taken in connection with the accompanying drawings in which.

DETAILED DESCRIPTION OF THE INVENTION

Figure 1:
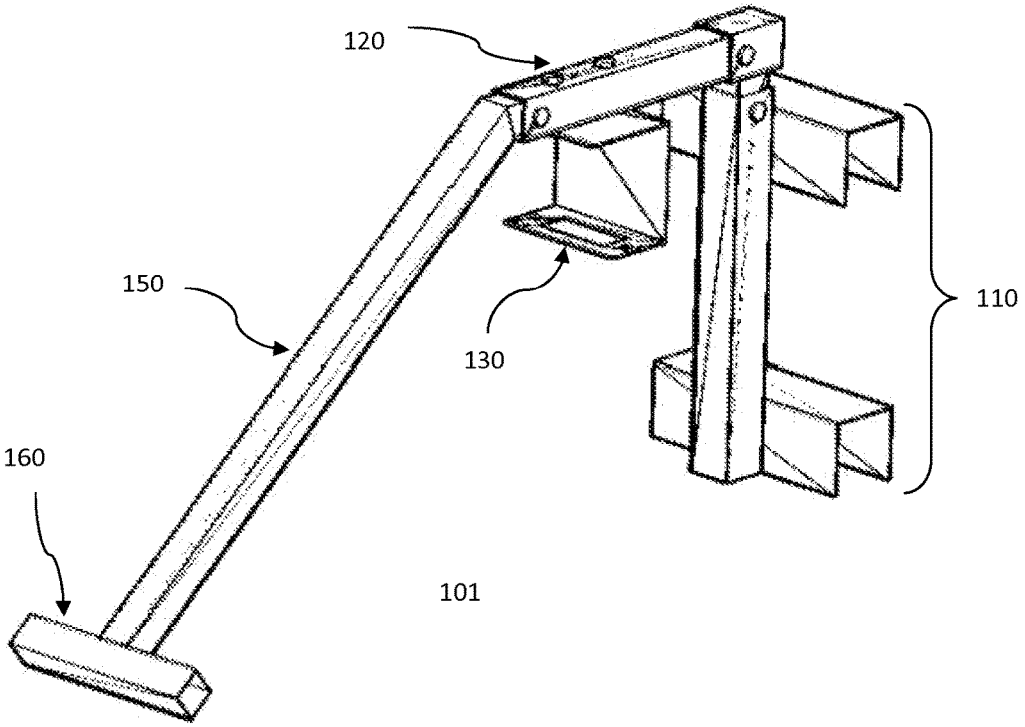
FIG. 1 is a perspective view illustrating a removable crane assembly for a STEPLADDER BASED CRANE SYSTEM not attached to a stepladder according to an embodiment of the present invention.

Referring now to the drawings, FIG. 1 shows a removable crane assembly 101 for a STEPLADDER BASED CRANE SYSTEM according to a preferred embodiment of the present invention wherein a Mounting Section 110 is coupled to a Boom 120 using an Adjustable Boom Support Bracket 115 and Bolts 180. In the preferred embodiment, a Winch Mount 130 is coupled to the Boom 120 also using Bolts 180. The Handlebar 160 is welded at a 90 degree angle to the Jib 150. The Jib 150 is bolted to the Boom 120 using Bolts 180.

Figure 2:
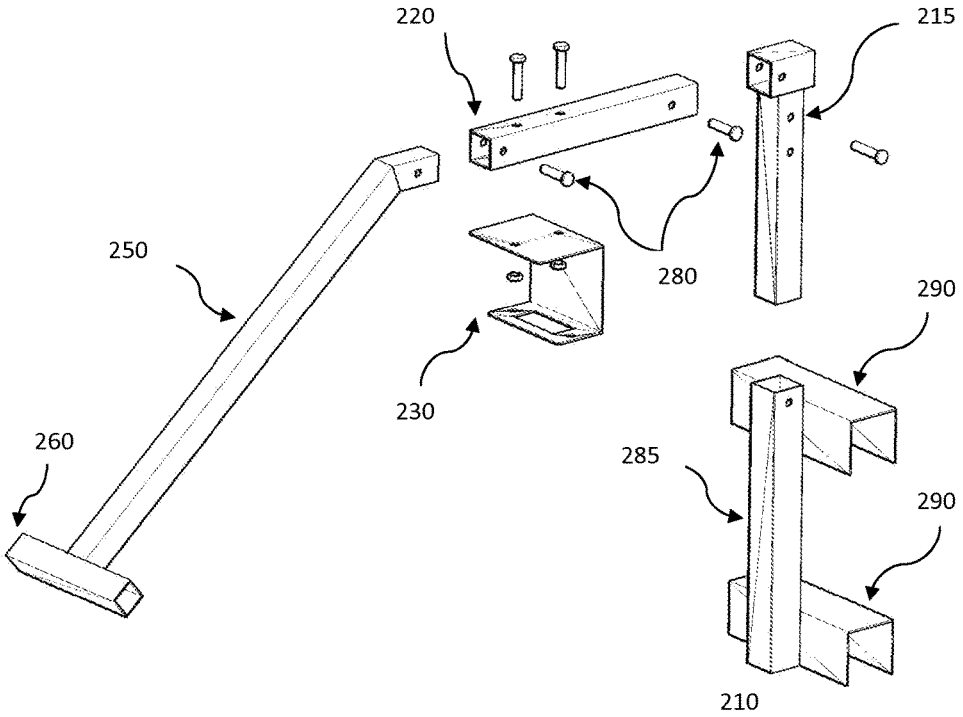
FIG. 2 is an exploded view illustrating a removable crane assembly for a STEPLADDER BASED CRANE SYSTEM according to an embodiment of the present invention.

As shown in FIG. 2 the mounting section 210 of the removable assembly 201 preferably is comprised of a vertical base member 285 with an upper and lower horizontally elongated stepladder rung grips 290, each of which is preferably a C-shaped, downwardly-opening channel. The stepladder rung grips 290 are preferably spaced and positioned to allow the removable crane assembly 201 to easily fit onto the rungs of a conventional stepladder, such as the type typically used by air conditioning technicians. An adjustable support bracket 285 fits into the vertical base member 285 and is secured by bolts 280.

Preferably fixed to the mounting section 210, a boom 220 is attached onto the adjustable boom support bracket 215 and adjustable boom support member 285 and extending opposite the stepladder rung grips 290 of the mounting section 210. The boom 220 is attached to the adjustable boom support bracket 215 with bolts 280. The adjustable boom support bracket 215 slides into and is attached to the adjustable boom support member 285 and secured using bolts 280. A winch mount 230 is preferably mounted on the boom 220 distal to the mounting section 210 using bolts 280. A winch preferably is positioned in the winch mount 230. A jib 250 preferably is attached to the boom 220 distally from the mounting section 110 using bolts 280, near the winch mount 230. A handlebar 260 preferably is mounted to the jib 250 distally from the boom 220 preferably extending at 90 degree angles from the jib 250. The handlebars 260 preferably extend to both sides of the jib 250 preferably parallel to the ground.

The handlebars 260 alternately preferably may extend at 45 degree angles from the jib 250, with grip positions preferably 90 degrees apart. A winch control module is preferably removably mounted on the jib 250 proximate to the handlebar 260 to allow for easy control during operation of the removable assembly 201. Alternately preferably the winch control module is mounted on the handlebar 260.

Figure 3:
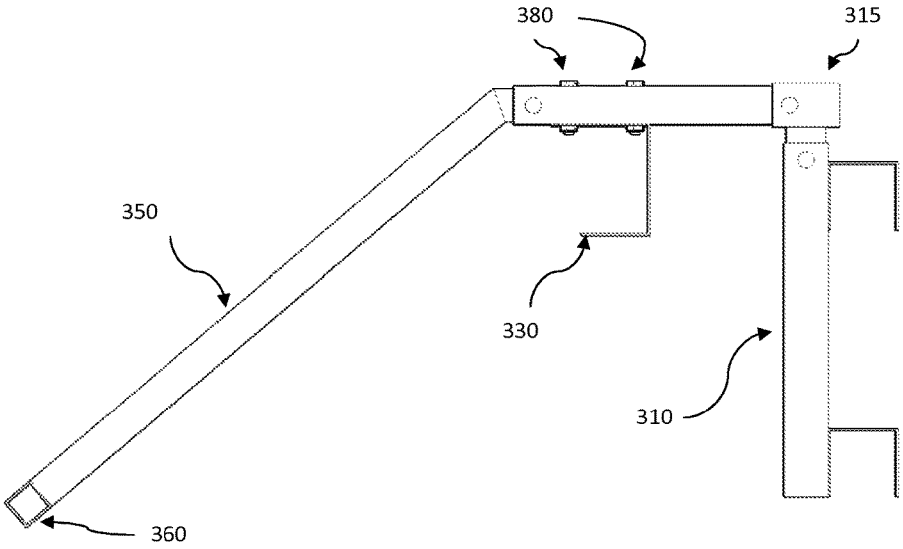
FIG. 3 is a top view illustrating a removable crane assembly for a STEPLADDER BASED CRANE SYSTEM not attached to a stepladder according to an embodiment of the present invention.

Referring to FIG. 3 where it can be seen that the Handlebar 360 is the most distal object from the Mounting Section 310 of the removable crane assembly 301. The Handlebar 360 is preferably affixed to the Jib 350. The Jib is attached to the Boom 320 using Bolts 380. And the Boom 320 is attached to the Adjustable Boom Support Member 315 that is further attached to the Mounting Section 310. The Winch Mount 330 can be seen extending out from underneath the Boom 320 attached with Bolts 380.

Figure 4:
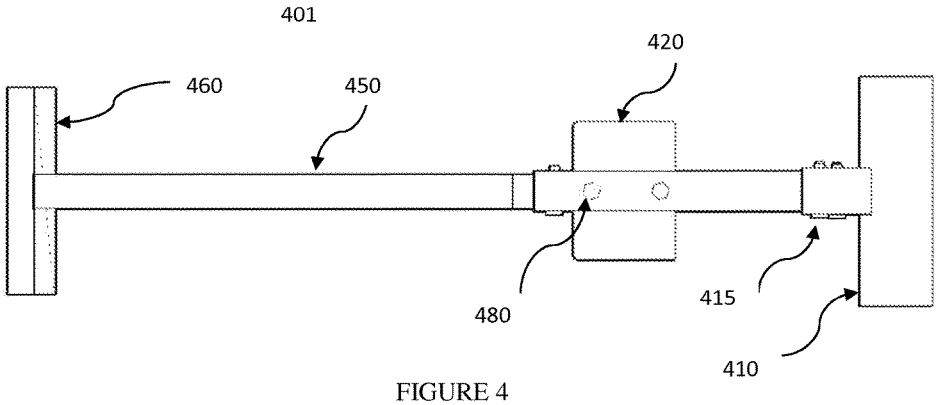
FIG. 4 is side top view illustrating a removable crane assembly for a STEPLADDER BASED CRANE SYSTEM not attached to a stepladder according to an embodiment of the present invention.

FIG. 4 shows the top view of the removable crane assembly 401 where it can be seen that the Handlebar 460 is attached to the Jib 450, which in turn is attached to the boom 420 using bolts 480, which is then attached to the adjustable boom support bracket 415 which is further attached to the mounting section 410, all using bolts 480.

Figure 5:
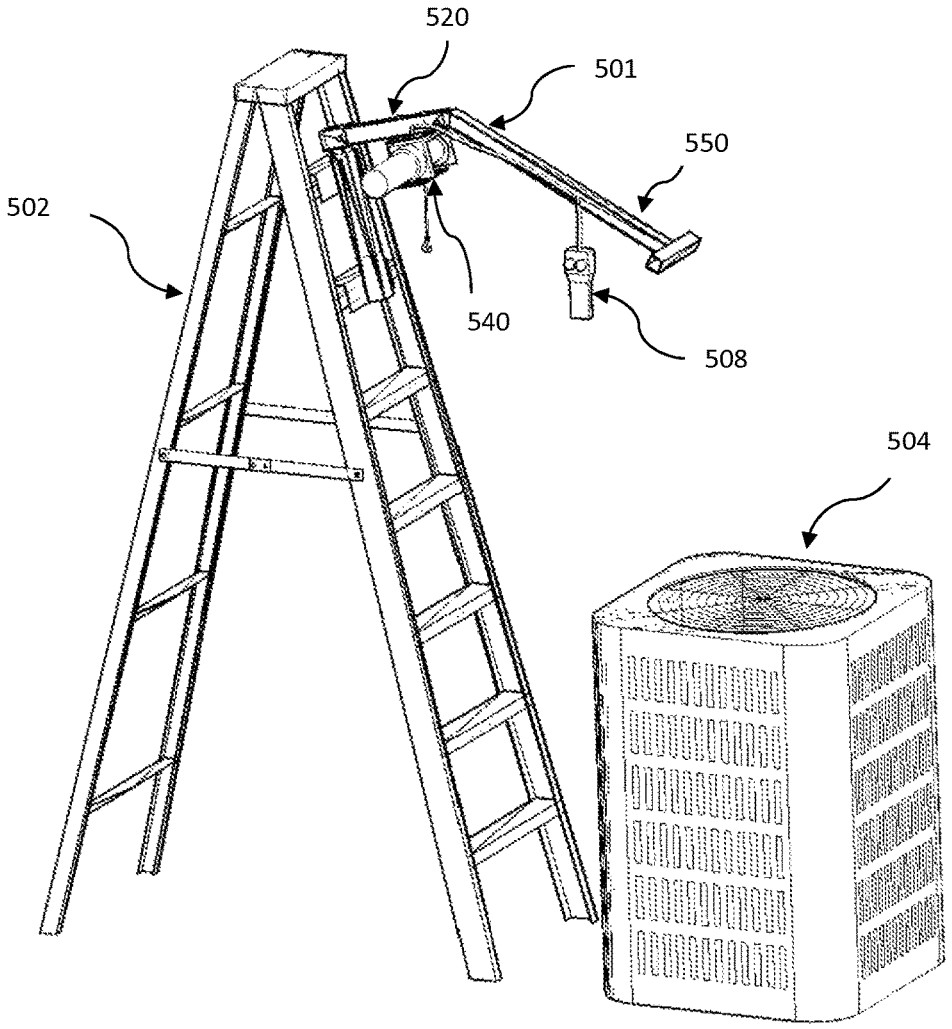
FIG. 5 is a perspective view illustrating the STEPLADDER BASED CRANE SYSTEM where a removable crane assembly is attached to a stepladder ready for use to remove an air conditioning compressor unit from a residential air conditioning assembly according to an embodiment of the present invention.

FIG. 5 shows how the removable crane assembly 501 is to be installed on a stepladder 502, and positioned next to the residential air conditioning assembly 504 for removal of the compressor. The winch 540 is shown located in the winch mount 530 under the boom 520 with the winch control module 508 removably attached to the jib 550.

Figure 6A:
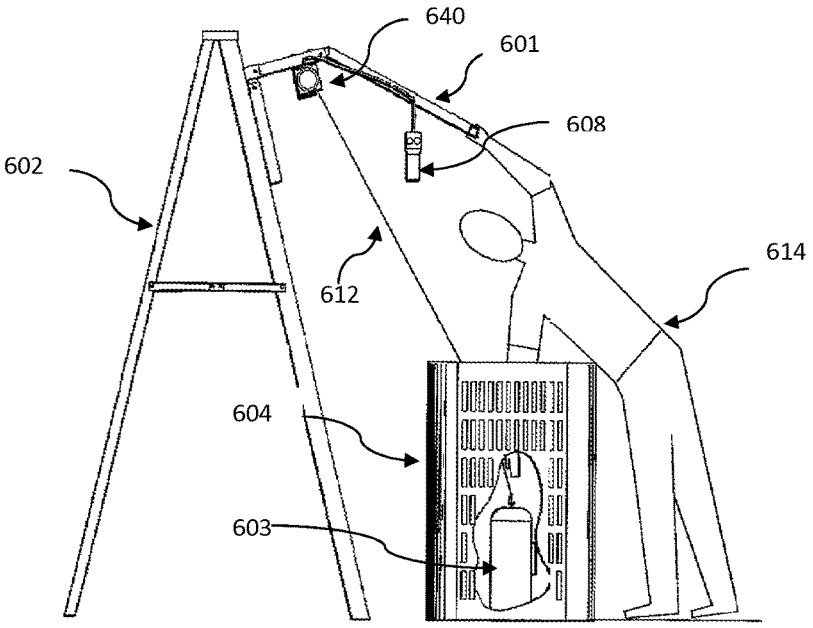
FIG. 6A is a perspective view illustrating the STEPLADDER BASED CRANE SYSTEM where a removable crane assembly is attached to a stepladder and being attached to an air conditioning compressor unit for removal.
Figure 6B:
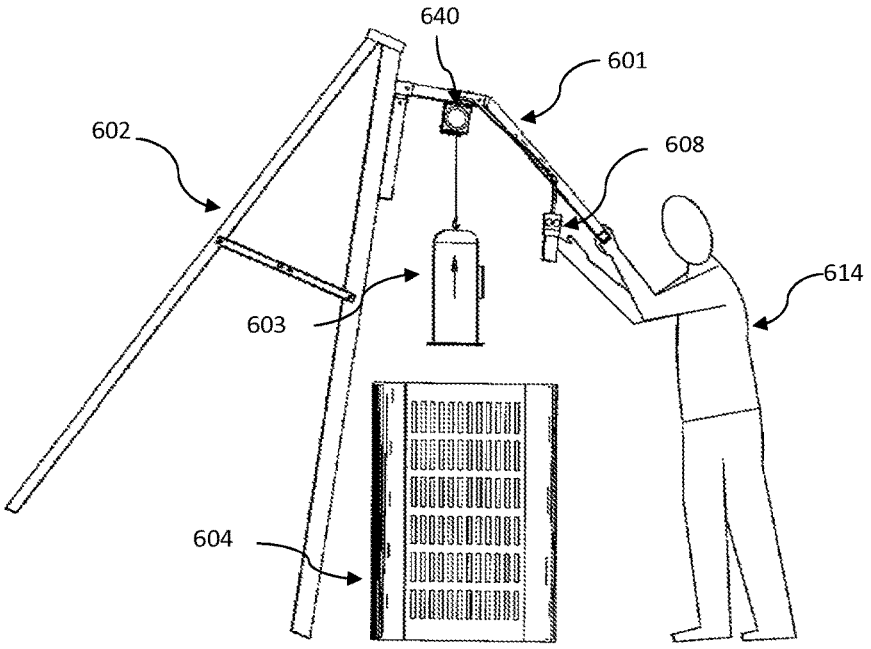
FIG. 6B is a perspective view illustrating the STEPLADDER BASED CRANE SYSTEM where a removable crane assembly is attached to a stepladder and has lifted an air conditioning compressor unit out of a residential air conditioning assembly.

FIGS. 6A and 6B show an air conditioning technician 614 operating the removable crane assembly 601 that has been mounted on a stepladder 602 to remove a residential air conditioning compressor unit 603. As can be seen in FIG. 6A, the air conditioning technician 614 is attaching the winch cable 612 to the air conditioning compressor unit 603 within an air conditioning assembly 604. As shown in FIG.

6B the air conditioning technician 614 then positions the removable crane assembly 601 to safely lift the air conditioning compressor unit 603 using the removable crane assembly 601 and the winch control module 608 to operate the winch 640.

Figure 7:
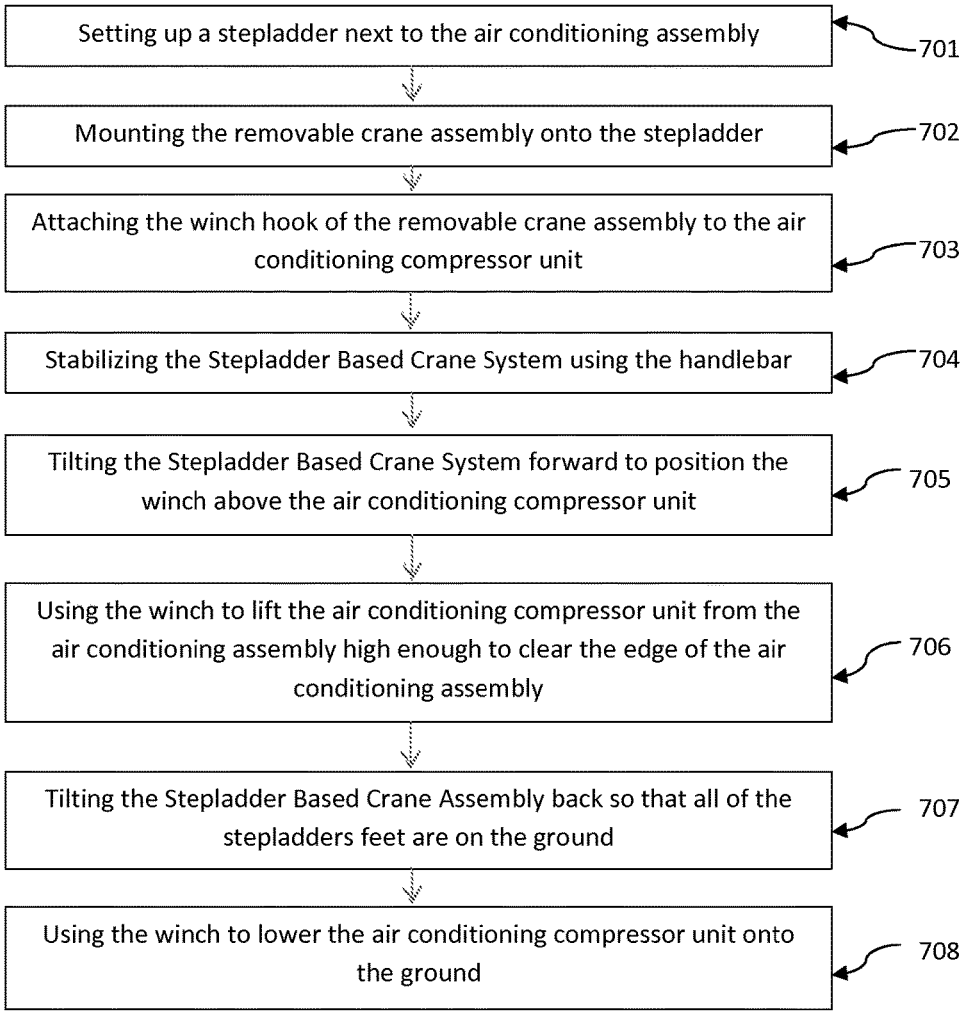
FIG. 7 is a flow chart illustrating the method of using the STEPLADDER BASED CRANE SYSTEM.

Referring to FIG. 7, which shows a method of using a Stepladder Based Crane System comprises the steps of: setting up a stepladder next to the air conditioning assembly 701, mounting the removable assembly onto the stepladder 702, attaching the winch hook of the removable assembly to the air conditioning compressor unit 703, stabilizing the Stepladder Based Crane System using the handlebar 704, tilting the Stepladder Based Crane System forward so the winch is directly above the air conditioning compressor unit 705, using the winch to lift the air conditioning compressor unit from the air conditioning assembly high enough to clear the edge of the air conditioning assembly 706, tilting the Stepladder Based Crane System back so that the air conditioning compressor unit is above the ground 707, and using the winch to lower the air conditioning compressor unit onto the ground 708.

Alternately preferably, a method of using a Stepladder Based Crane System comprises a technician operating the position of the Stepladder Based Crane System with one hand using the handlebar, while operating the winch controls of the Stepladder Based Crane System using another hand.

What is claimed is:

1. A ladder mounted crane system comprising:

an A-frame stepladder comprising a first leg and a second leg, the first leg comprising a plurality of rungs; and a portable crane assembly configured to removably attach to at least one of the plurality of rungs of the first leg of the A-frame stepladder at a predetermined angle such that the portable crane assembly extends outwardly from the first leg of the A-frame stepladder, wherein the portable crane assembly comprises a mounting section and a boom section removably attached to an upper portion of the mounting section;

wherein the mounting section comprises a plurality of elongated members attached perpendicular to a vertical base member, each of the plurality of elongated members comprising a downwardly-opening channel which opens toward a bottom portion of the mounting section opposite the upper portion of the mounting section and configured to grip a rung of the first leg of the A-frame stepladder;

wherein the boom section comprises a boom having a first end attached to the upper portion of the mounting section, a winch attached to a bottom surface of the boom, a jib having a first jib end attached to the boom, a handlebar attached to a second jib end opposite the first jib end, and a control module electrically coupled to the winch; and wherein the second leg of the A-frame stepladder acts as a counterbalance to the portable crane assembly.

2. The ladder mounted crane system of claim 1 wherein the control module is removably attached to the jib.

3. The ladder mounted crane system of claim 1 wherein the control module is removably attached to the jib near the handlebar.

4. The ladder mounted crane system of claim 1 wherein the portable crane assembly is further configured to removably attach to a consecutive pair of rungs in the plurality of rungs of the first leg of the A-frame stepladder at the predetermined angle such that the portable crane assembly extends outwardly from the first leg of the A-frame stepladder.

5. The ladder mounted crane system of claim 1 wherein the mounting section of the portable crane assembly is attached to the boom using an adjustable boom support bracket and a plurality of bolts.

6. The ladder mounted crane system of claim 5 wherein the adjustable boom support bracket slides into and is attached to an adjustable boom support member and secured using the plurality of bolts.

7. The ladder mounted crane system of claim 1 wherein the handlebar is welded to the jib at approximately a 90 degree angle.

8. The ladder mounted crane system of claim 1 wherein the handlebar extends at approximately a 45 degree angle from the jib and comprises grip positions at about 90 degrees apart.

9. The ladder mounted crane system of claim 1 further configured to be operated by a technician having a first hand positioned on the handlebar and having a second hand positioned to operate winch controls.

* * * * *